US005993293A

United States Patent [19]

Cesna et al.

[11] Patent Number: 5,993,293

[45] Date of Patent: Nov. 30, 1999

[54] METHOD AND APPARATUS FOR IMPROVED SEMICONDUCTOR WAFER POLISHING

[75] Inventors: Joseph V. Cesna, Niles, Ill.; Inki Kim, Tempe, Ariz.

[73] Assignee: Speedram Corporation, Chanlder, Ariz.

[21] Appl. No.: 09/098,774

[22] Filed: Jun. 17, 1998

[51] Int. Cl.[6] ..... B24B 1/00

[52] U.S. Cl. ..... 451/41; 451/44; 451/59; 451/63

[58] Field of Search ..... 451/41, 44, 59, 451/63, 285, 286, 287, 288, 398

[56] References Cited

U.S. PATENT DOCUMENTS

| | | | |
|---|---|---|---|
| 5,101,602 | 4/1992 | Hashimoto | 51/216 |
| 5,127,196 | 7/1992 | Morimoto et al. . | |
| 5,445,486 | 8/1995 | Kitayama et al. | 414/416 |
| 5,556,147 | 9/1996 | Somekh et al. | 294/64.1 |
| 5,573,448 | 11/1996 | Nakazima et al. | 451/41 |
| 5,609,719 | 3/1997 | Hemple | 156/636.1 |
| 5,615,988 | 4/1997 | Wiesler et al. | 414/416 |
| 5,624,299 | 4/1997 | Shendon | 451/28 |
| 5,636,964 | 6/1997 | Somekh et al. | 414/786 |
| 5,647,626 | 7/1997 | Chen et al. | 294/87.1 |
| 5,681,215 | 10/1997 | Sherwood et al. | 451/388 |
| 5,851,140 | 12/1998 | Barns et al. . | |
| 5,871,393 | 2/1999 | Shiozwa . | |

FOREIGN PATENT DOCUMENTS

| | | |
|---|---|---|
| 0 790 100 A1 | 8/1997 | European Pat. Off. . |
| 8-257893 | 10/1996 | Japan . |

*Primary Examiner*—Timothy V. Eley
*Assistant Examiner*—Willie Derry, Jr.
*Attorney, Agent, or Firm*—Fitch, Even, Tabin & Flannery

[57] ABSTRACT

In semiconductor wafer polishing, a backing pad is sized smaller than the wafer being polished so as to produce a desired backset, allowing the wafer to bend, thereby reducing over-polish at the wafer edge.

14 Claims, 6 Drawing Sheets

METHOD AND APPARATUS FOR IMPROVED SEMICONDUCTOR WAFER POLISHING

BACKGROUND OF THE INVENTION

1. Field of the Invention

The present invention pertains to the precision surface machining of semiconductor wafers, and in particular to chemical/mechanical polishing (CMP) of silicon and other types of semiconductor wafers.

2. Description Of The Related Art

In the commercial production of semiconductor wafers, a semiconductor wafer undergoes successive operations in which relatively thin layers of conductive, semiconductive and dielectric materials are formed on one of the wafer's major surfaces by metalization, sputtering, ion implantation and other conventional techniques. Although the thicknesses of such layers is measured in terms of microns or micro inches, the exposed surfaces must be polished flat, in preparation for successive layering operations.

The SpeedFam Corporation of Chandler, Ariz., Assignee of the present invention, manufactures a variety of equipment for planarizing and otherwise preparing wafer surfaces using a variety of techniques, including chemical/mechanical polishing (CMP) processes. Typically, the layered surface (device side) of the wafer is placed face down on the polish pad carried on a rotating table or incorporated in a linear belt. A chemically active media which may also contain abrasive particles is introduced onto the polish table and migrates between the wafer and the polish pad. A carrier and compressible backing pad apply a downforce to the back side of the wafer, pressing the device side of the wafer against the polishing pad surface. Typically, the polish pad is made considerably larger than the diameter of the wafer being polished. The carrier applying downforce to the wafer is rotatably driven about a vertical axis so as to rotate the wafer with respect to the moving polish pad surface, thereby increasing the relative motion between the wafer and the polish pad. Typically, the carrier and hence the wafer is also reciprocated back and forth along an arc, usually intersecting a radial line originating at the center of the polish pad.

In order to maintain the wafer underneath the carrier despite sideways or lateral dislodging forces, a retaining ring sometimes called a "polishing ring", dimensioned to loosely surround the wafer, travels with the carrier, with the wafer being held captive within the retaining ring. The retaining ring is thereby held in close relationship and oftentimes in contact relationship with the polish pad surface, which inevitably affects the flow of slurry between the wafer and polish pad surface.

It has been observed in commercial wafer polishing operations that despite precautions to the contrary, the material removal rate is not uniform across the wafer surface. For example, even though the wafer carrier is made relatively flat and rigid so as to apply a uniform downforce throughout the wafer back side surface, the outer annular edge regions of the wafer show evidence of an increased material removal compared to the inner portions of the wafer, a so-called "over-polishing" condition. This introduces wafer non-uniformities such as deviations from wafer global uniformity. Further, the wear at the edge region of the wafer is increased to the point where devices located in the edge region may undergo substantial degradation. There is an increasing emphasis among manufacturers of semiconductor devices that the total area of such degradation ("edge exclusion") be reduced. As semiconductor devices become larger, edge exclusion is more likely to play a role in reducing the number of devices that can be obtained from a semiconductor wafer.

Several attempts at reducing edge over polish have been attempted. For example, polishing operations employing retaining rings have been made to apply an added downforce to the retaining rings sufficient to partly compress the polish pad, thus locally deflecting the polish pad beneath the edge region of the wafer being polished. In another proposed arrangement, U.S. Pat. No. 5,573,448 provides a recess or groove in the backing pad at the outer periphery of the wafer. The recess, however, allows the slurry to become trapped, thereby modifying the downforce on the wafer being polished, in an angularly non-uniform manner, again leading to global irregularities in the wafer surface. Further, U.S. Pat. No. 5,573,448 is directed to use of a polishing template in which multiple wafer, held by a common template, are polished at the same time. The wafers and template together form a polishing system in which local forces and excursions within the system are transmitted to other parts of the system, with a polishing of one wafer being affected by another in a time varying manner as the polishing operation is being carried out. Improvements in wafer polishing are continually being sought.

SUMMARY OF THE INVENTION

It is an object of the present invention to provide wafer polishing having improved global uniformity.

Another object of the present invention is to provide improved chemical/mechanical polishing of semiconductor wafers in a manner so as to reduce edge exclusion.

These and other objects according to the principles of the present invention are provided in a method of polishing a surface of a semiconductor wafer having an outer peripheral portion, a predefined diameter and a predefined thickness, comprising:

providing a polishing pad;

providing a rigid pressure plate;

providing a backing pad between the pressure plate and the wafer, the backing pad having a substantially uniform thickness, a substantially uniform hardness ranging between 30 Shore A hardness and 60 Shore D hardness and an outer diameter smaller than the outer diameter of the wafer by a backset amount;

the backset amount ranging between one and four times the predefined wafer thickness; and applying a downforce to the pressure plate and the backing pad to force a central portion of the semiconductor wafer into contact with the polishing pad and to bend the outer peripheral portion of the wafer toward the pressure plate.

DETAILED DESCRIPTION OF THE PREFERRED EMBODIMENTS

Figure 1:
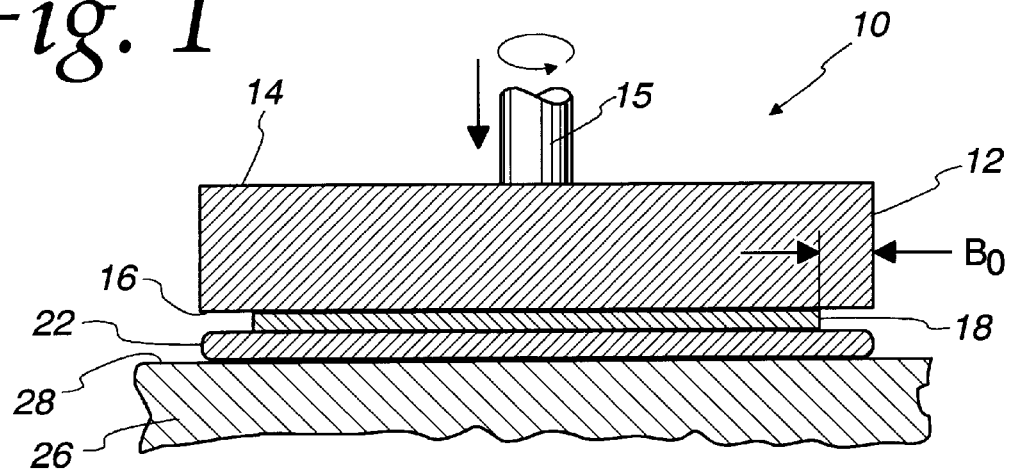
FIG. 1 is a cross-sectional view of a polishing arrangement according to principles of the present invention.
Figure 2:
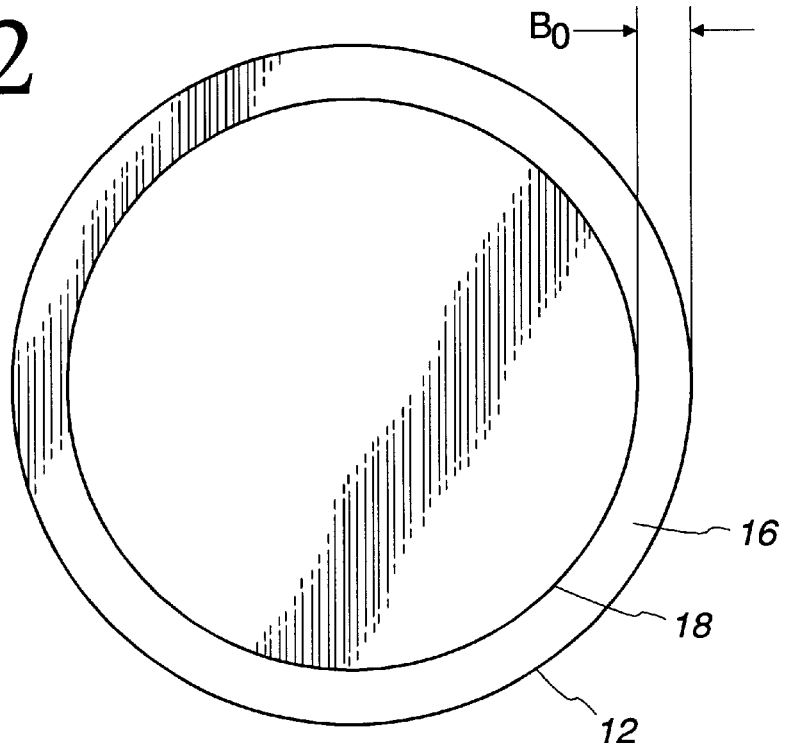
FIG. 2 is a bottom plan view of the backing pad and carrier of FIG. 1.

Referring now to the drawings, and initially to FIGS. 1–8, several arrangements are illustrated for the chemical/mechanical polishing (CMP) or other polishing of silicon and other types of semiconductor wafers. Referring initially to FIGS. 1 and 2, a polishing arrangement generally indicated at 10 includes a pressure plate 12 of conventional construction. Pressure plate 12 is typically made of a rigid material, such as stainless steel, and is dimensioned so as to be relatively massive to avoid flexing when a down pressure is applied by gimbal connection (not shown) to an operating shaft 15. Alternatively, pressure plate 12 may exhibit some flexing, but preferably, the pressure plate is made to be more rigid than the wafer being polished. Pressure plate 12 has a back surface 14 and a front, downwardly facing surface 16. A backing pad of conventional construction is indicated by the reference numeral 18 and is located between the front surface 16 of pressure plate 12 and a single semiconductor wafer 22. Wafer 22 has a front face or "device side" facing a polish pad 26 having an upper polishing surface 28. The back side of wafer 22 contacts backing pad 18. Polish pad 26 is carried on a relatively massive polishing table (not shown) which is usually rotatably driven about a vertical axis. Together, the pressure plate 12 and backing pad 18 cooperate to apply a downforce to the back side of wafer 22 forcing its front side into contact with polishing pad 28. As mentioned, it is preferred that the gimbaled pressure plate apply force to only a single wafer, and that a multi-wafer process with multi-wafer templates be avoided.

As mentioned, polish pad 26 is carried on a polish table which is typically rotated about a vertical axis. Although a polishing action can be obtained with pressure plate 12 being held stationary, it is generally preferred that the pressure plate be rotated about the axis of operator shaft 15 in the same direction and/or in a counter rotating direction with respect to the direction of rotation of polish pad 26. In addition, it is generally preferred that operating shaft 15 be carried on an arm or other mounting arrangement which moves the pressure plate in directions generally parallel to the upper polish pad surface 28. Accordingly, wafer 22 is made to undergo relatively complex continually changing motions during a polishing operation.

As is known in the art, it is generally preferred that the polishing operation be carried out in a liquid "slurry" which is introduced between wafer 22 and polishing surface 28. In practice, the entire upper surface 28 of polishing pad 26 is "flooded" with a liquid slurry composition, and the relative motion between wafer 22 and polishing surface 28 is relied upon to draw the slurry between the wafer and polishing pad surface. As is known in the art, the "slurry" may be formulated with or without abrasive material, and may further be formulated with a liquid media which may be chemically inert with respect to the wafer or, alternatively, may chemically react with the wafer surface so as to accelerate material removal from the wafer surface undergoing polishing. Further, it is known to use deionized water either before or after the principal polishing operation has been performed.

As is known in the art, the rate of material removal from the surface of wafer 22 depends upon a number of factors. Included, for example, is the amount of downforce applied to the wafer by the pressure plate and backing pad combination, the softness or resilience of the backing pad, the softness and abrasive nature of the polish pad surface, the relative rates of rotation of the wafer and polish pad and the composition and temperature of the slurry. The highest rates of material removal from the wafer are typically associated with slurries having a chemically active media which reacts with the wafer surface, and in which is suspended abrasive particles which are relatively sharp and sized so as to move to some extent between the wafer and polish pad surface.

FIG. 1 shows a circular pressure plate, a circular backing pad and a circular wafer in a cross-section taken through their respective diameters. Typically, the backing pad 18 is affixed in a conventional manner to the front surface 16 of pressure plate 12, in concentric alignment therewith. The polishing arrangement 10 is designed such that wafer 22 is held in concentric alignment with the pressure plate. For example, a series of holes may be formed in the pressure plate and backing pad and a vacuum applied therethrough to apply a suction force to the wafer. As will be seen herein with reference to FIG. 9, the present invention is readily adapted for use with so-called "guide rings" or "retaining rings" which limit the lateral movement of the wafer away from its concentric position.

As is known in the art, polishing with a conventionally sized backing pad (i.e., approximately as large as the wafer being polished) and a conventional, full-sized pressure plate also at least as large as the wafer being polished, the rate of polishing at the wafer periphery is faster than the polish rates experienced at interior portions of the wafer surface. The faster polish rates are believed to be due, at least in part, to a non-uniform deformation of the upper surface of the polish pad. In response to this observed problem, it has been proposed that an outer surrounding guide ring attached to the pressure plate, be dimensioned so as to interfere with the polish pad, compressing the polish pad at points beyond the wafer periphery. Such arrangements have not been found to be totally satisfactory, and, accordingly, there is an ongoing interest in improving global planarity as well as uniform polishing rates across substantially the entire wafer surface. Changing market conditions have also required a solution to the over-polish condition at the wafer edge. For example, the semiconductor industry has charted future enhancements and goals associated with over-polishing operations. For example, in recent years a 5 millimeter edge exclusion has been acceptable for wafers of 200 millimeter size. However, according to current requirements, edge exclusion must now be reduced to 3 millimeters and must be further reduced in the next few years to 2 millimeters, concurrent with an increase of wafer size from 200 millimeters to 300 millimeters. Accordingly, the amount of edge exclusion permissible is being rapidly reduced in substantial amounts.

As can be seen in FIG. 1, the diameter of pressure plate 12 is made approximately equal to the diameter of wafer 22, and such represents a conventional practice of the prior art. However, according to one aspect of the present invention, the backing pad 18 is "undersized" a precise "backset" amount. The amount of backset of the backing pad 18 with respect to the wafer 22 is indicated by the dimension $B_0$. As can be seen in the bottom plan view of FIG. 2, backing pad 18 is generally circular in form and is concentrically aligned with respect to pressure plate 12. An outer annular peripheral portion of pressure plate front surface 16 is exposed due to the backset ("undersizing") of backing pad 18.

It should be noted that the backing pad wafer and polish pad are schematically indicated for illustrative purposes in their "rest" condition. In practice, depending upon the amount of downforce applied by pressure plate 12, the backing pad 18 deforms somewhat, and the wafer 22 is pressed into the upper surface 28 of polish pad 26. Depending upon a number of conditions, including the amount of backset and the materials properties of the backing pad wafer and polish pad, the outer peripheral portion of the wafer 22 may be deflected toward the backing pad, as schematically indicated, for example, in FIGS. 7 and 8.

With reference to FIGS. 1–8, attention will now be directed to the amount of backset introduced in a practical polishing system and its accompanying changes in polish performance. It has been found useful in developing the present invention, to study the (approximate) relationship between the amount of backset and the wafer thickness. The wafer thickness has been observed to provide a convenient, approximate indication of a wafer bending resistance. As will be seen herein, the backing pad backset (measured with respect to the wafer carrier diameter) if made large enough, causes the peripheral edge portion of the wafer to bend on polishing. If the amount of wafer bending is made great enough, the rate of polishing of the wafer periphery can be lessened.

Figure 3:
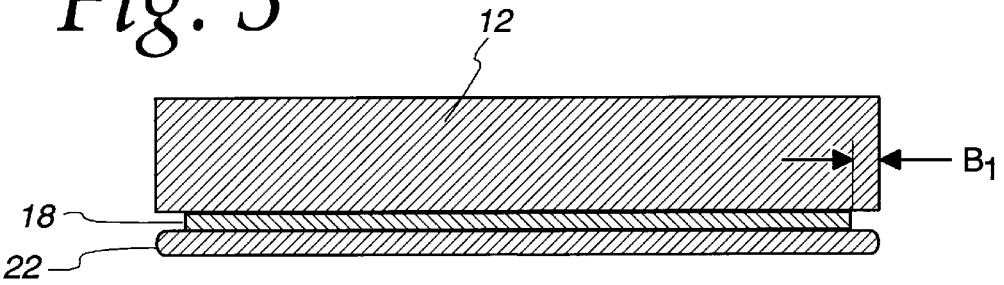
FIG. 3 is a cross-sectional view similar to that of FIG. 1 showing a reduced back set of the backing pad with respect to the carrier.
Figure 4:
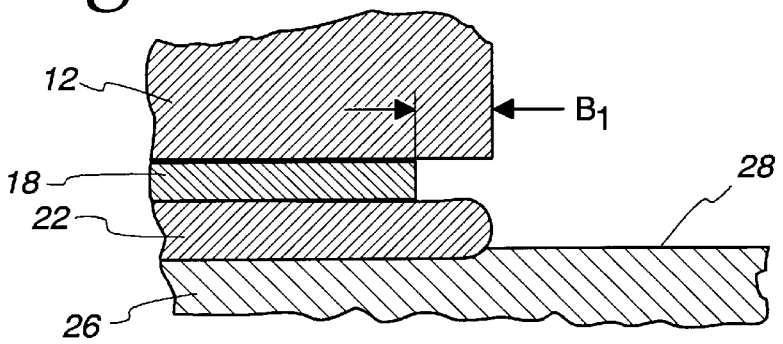
FIG. 4 is a fragmentary view similar to the right hand portion of FIG. 1, but showing the wafer in an exaggerated upwardly bend condition.

In FIGS. 3–8, three different representative backset values are illustrated. The backset values $B_1$ and $B_2$ illustrated in FIGS. 3–6 are smaller than preferred, while the backset value $B_0$ illustrated in FIGS. 7 and 8 produces a desirable result. Referring now to FIGS. 3 and 4, the backing pad backset $B_1$ is set approximately equal to the thickness of wafer 22. As schematically indicated in FIG. 4, at most, only a negligible amount of bending at the wafer outer periphery is experienced, and the polish pad 26 is sufficiently resilient so as to maintain substantially complete engagement with the wafer "device side", i.e., lower surface. Under the conditions schematically illustrated in FIGS. 3 and 4, over-polish at the peripheral portion of wafer 22 is not adequately alleviated. Accordingly, any devices formed in the periphery of the lower wafer surface are subjected to accelerated polishing which, in a commercial environment, may result in the electronic devices at the wafer edge to be excluded from the useful yield obtainable by an electronic device manufacturer.

Figure 5:
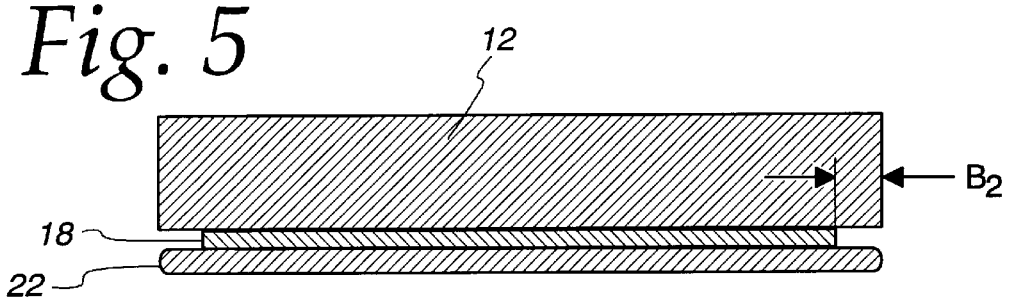
FIG. 5 is a cross-sectional view similar to that of FIG. 3 but showing a slightly increased backset of a backing pad with respect to the carrier.
Figure 6:
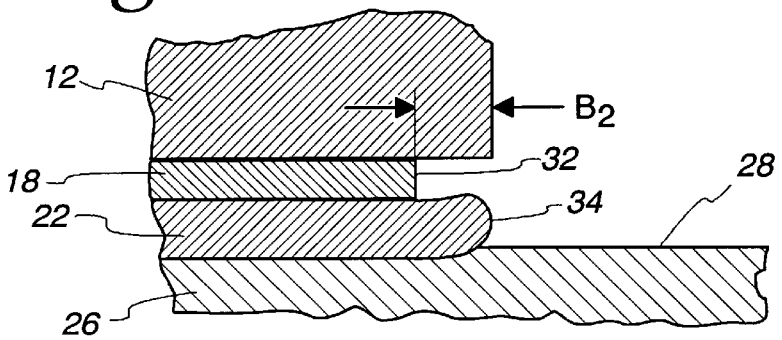
FIG. 6 is a fragmentary view similar of the right hand portion FIG. 5 shown under typical operating conditions.

Referring now to FIGS. 5 and 6, the amount of backset of the backing pad 18 with respect to wafer 22 is increased to an amount $B_2$ corresponding approximately to 1.5 to 2.5 times the wafer thickness. As schematically illustrated in FIG. 6, for the materials employed, the outer peripheral edge of wafer 22 undergoes a slight amount of bending beginning at a point corresponding generally with the outer free edge 32 of backing pad 18, which, depending upon its material composition, may experience a relatively small amount of compression associated with the upturned free edge 34 of wafer 22. As schematically at the bottom of FIG. 6, backing pad 26 is deformed a certain amount by the downforce applied to wafer 22. However, despite the increased backset $B_2$ and the greater upturning of the peripheral edge portion of wafer 22, over-polishing at the wafer edge is not adequately overcome.

Figure 7:
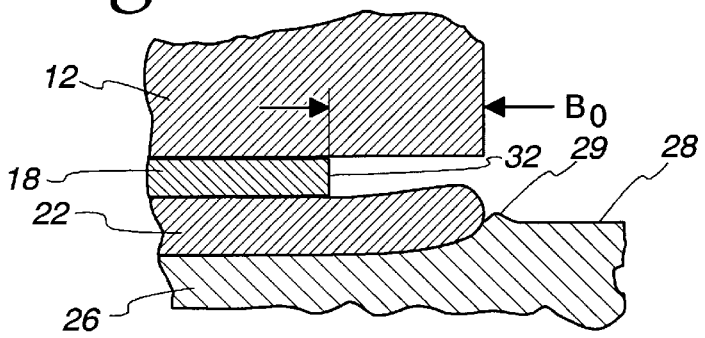
FIG. 7 is a fragmentary cross-sectional view of the right hand portion of FIG. 1, shown on an enlarged scale, under typical operating conditions.
Figure 8:
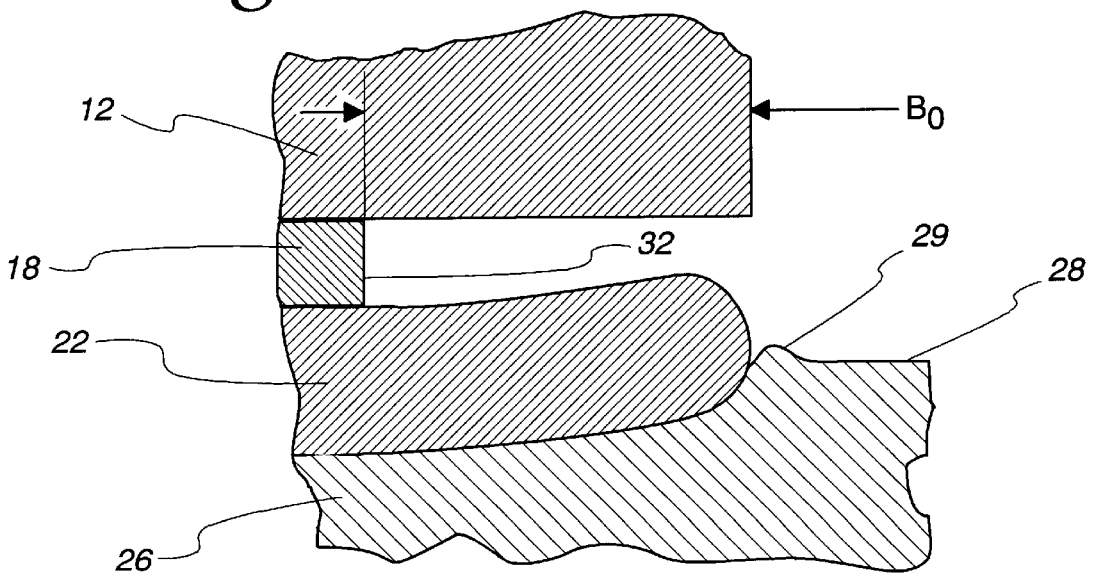
FIG. 8 shows a fragmentary portion of FIG. 7 on an enlarged scale.

Turning now to FIGS. 7 and 8, the amount of backset of the backing pad 18 with respect to wafer 22 is increased to an amount roughly two to three times the wafer thickness, as indicated by the reference designator $B_0$. As schematically indicated in FIG. 7, the backing pad 26 is still able to conform to the lower surface of wafer 22, despite the increased bending of the wafer. It has been found desirable to avoid lifting the wafer periphery above the upper surface 28 of polish pad 26. As schematically indicated in FIGS. 7 and 8, a "wave" or disturbance of the pressure pad surface, indicated at 29, may develop depending upon the pressure pad construction, the downforce applied and relative velocities and coefficients of friction of the polish pad, wafers and intervening slurry. As understood, the wave can be employed to help in avoiding lifting the wafer periphery above the upper surface of the polish pad. Although a slight amount of polishing at the wafer periphery may continue, over-polishing of the outermost peripheral edge of wafer 22 is effectively overcome.

As can be seen from the above, a sufficient amount of backset of the backing pad with respect to the pressure plate will alleviate over-polishing of the wafer peripheral portions. As explained above, various factors operate in a practical operation, to influence the effect that a given amount of backset has on edge exclusion (i.e., the over-polishing of the outer peripheral portion of the wafer). It has been found, for a given polish pad composition and thickness, that the greatest factor affecting the ability of backset to control edge exclusion, is the hardness of the backing pad 18. For the range of semiconductor wafers and backing pads in conventional current use, a backset ranging between one and four times the wafer thickness has been found to be adequate to provide the necessary lift of the wafer outer edge to reduce edge exclusion to a few millimeters. More preferably, backset values ranging between 1.25 and 3.25 have been found adequate, and with readily available commercial backing pad materials such as soft rubber, and backing pad Model Nos. WB-20 and IC-1000 from Rodel Corporation, backset values ranging between 1.5 and three times the wafer thickness have been found adequate to limit edge exclusion to the outermost peripheral region of the wafer, of several millimeters.

Several examples will now be given for a constant polish pad configuration, and a constant wafer of silicon material having a thickness t of 0.74 millimeter. In the first example, a relatively soft backing pad material is made of natural rubber having a Shore A hardness of 30. This backing pad required a backset of 1t±0.5t to successfully eliminate edge exclusion (i.e., edge over-polish).

In a second example, a medium value backing pad, made of $SF_3$ material having a Shore A hardness of 55–60 was found to require a backset of 2t±0.5t to eliminate edge exclusion. Thus, for a doubling of Shore A hardness value, an approximate doubling of the backset was required in order to successfully eliminate edge over-polish. The $SF_3$ backing pad materials investigated comprised a commercial product Model WB-20 obtained from the Rodel Corporation.

One of the hardest backing pad materials under consideration here, sold by Rodel Corporation under the Model designator IC-1000 has a Shore D value ranging between 50 and 60. An increase in backset proportional to the increase in hardness of the backing pad was barely able to produce acceptable reduction in over-polish for a portion of the samples observed. A backset of 3t±0.5t (slightly larger than the proportional increase related to hardness) was found to provide adequate elimination of edge over-polish for the harder backing pad material. The hardness of the Rodel IC-1000 backing pad material was found to vary somewhat from one sample to another, in accordance with the manufacturer's specifications and thus added somewhat to the variability of the results.

Other subtle factors were identified which may influence observed polishing results. For example, polish pads (and to some extent, backing pads) utilized throughout a series of tests become loaded with particulate (comprising either slurry particles and/or wafer material particles). Thus, the resilience as well as the abrasiveness of the affected portion of the polish pad (i.e., its upper polish surface) is changed slightly as the polish process continues. Changes in wafer surface roughness will require the operator to adjust downforce of the machine and this in turn will directly affect the extent to which the upper surface of the polish pad bears against the curved and uncurved portions of the device side surface of the wafer.

Not surprisingly, it is difficult, if not impossible, to arrive at a precise mathematical relationship between the amount of backset and other factors involved in the polishing operation, which indicates successful elimination of over-polishing of the outer portion of the wafer surface. However, a range of backset values has been established for a wide variety of backing pad hardness values, as noted above. It is anticipated that initial adjustments of backset in the middle of each stated range may produce a marked drop in edge over-polishing. However, it is also recognized that a slight adjustment within the stated range away from the middle value may be necessary in order to better optimize the process in order to obtain the reduction desired in edge over-polish for the particular conditions encountered.

As can be seen in FIG. 8, it is preferred that the backset be defined by a free edge of a backing pad and not by a recess or groove in the backing pad in which slurry can become trapped. As indicated in FIG. 8, it is preferred that the backing pad free edge be generally perpendicular to the plane of the major, central portion of the wafer being polished (i.e., the backing pad free edge 32 in FIG. 8 is aligned along a generally vertical direction). The free edge 32 could be angled a slight amount, within about 30 degrees of the preferred perpendicular direction, so as to avoid unnecessary non-linearization of the backing pad compression.

Figure 9:
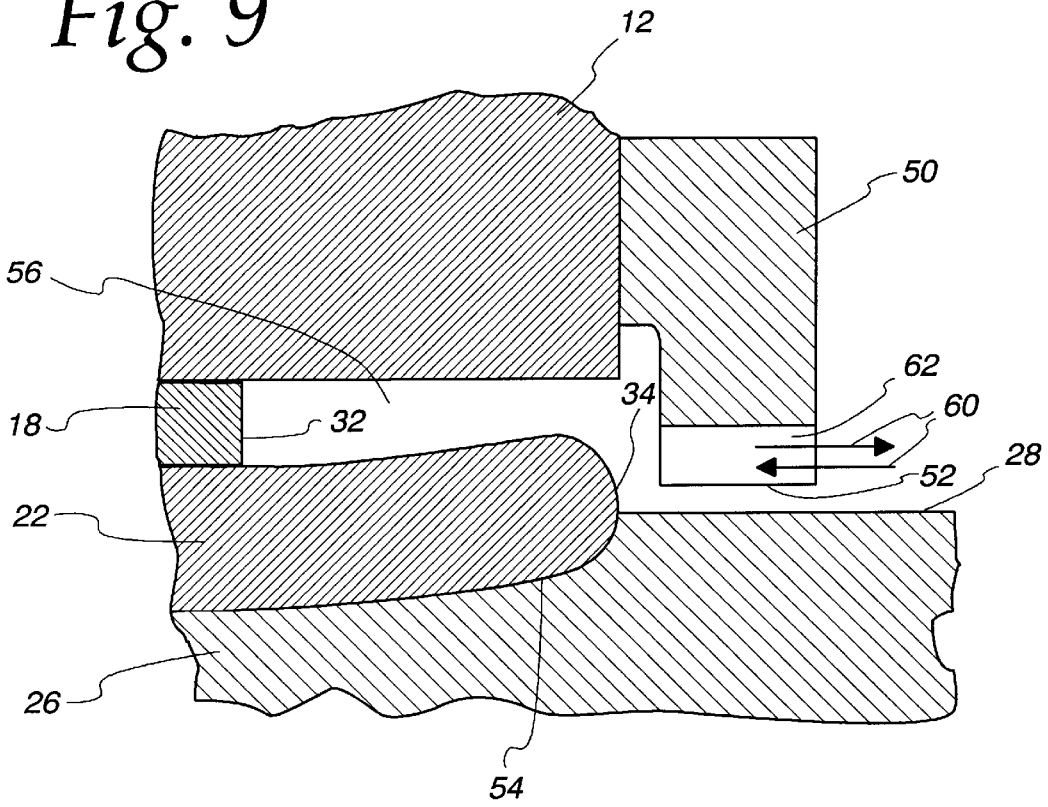
FIG. 9 shows the arrangement of FIG. 8 with the addition of a polishing ring.

Referring now to FIG. 9, an arrangement similar to that of FIGS. 7 and 8 is shown, but with the addition of a guide ring or retaining ring 50. The retaining ring shown in FIG. 9 is attached in a conventional manner to pressure plate 12 and extends generally to the upper surface 28 of polish pad 26. In practice, it is preferred that the bottom edge of the retaining ring 50 be spaced slightly above the upper surface 28 of polish pad 26, by a distance preferably no more than one-half the thickness of the wafer being polished. Accordingly, for a wafer of 0.74 millimeter thickness, retaining ring 50 is dimensioned such that its bottom free edge 52 is elevated a small distance, preferably 0.30 millimeter above the upper polish surface 28. It has been found important to provide a certain amount of free circulation of polishing slurry between the wafer 22 and upper polish surface 28. As schematically indicated the figures, the wafers are provided with a rounded or chamfered edge so as to encourage the introduction of slurry between the wafer device side surface and the upper polish pad surface. With the present invention, backset of the backing pad produces an uplift or convex bending of the wafer device side surface 54 while maintaining engagement with the polish pad surface 28 to maintain flatness of the wafer edge.

The cavity 56 formed within the retaining ring 50 allows a free circulation with slurry entering and leaving cavity 56 as indicated by the double arrow 60.

In addition to the gap formed between the bottom end 52 of the retaining ring and the polish pad surface, channels 62 are formed in the retaining ring 50 in accordance with commonly assigned U.S. Pat. No. 5,685,766, the disclosure of which is incorporated herein by reference as if fully set forth herein. As indicated in FIG. 9, the guide ring 50 is spaced a slight distance from the outer free edge 34 of wafer 22. In one example, a wafer of 0.74 millimeter thickness and an outer diameter of 200 millimeters±0.25 millimeter is supported by a backing pad having a diameter ranging between 197 millimeters and 199 millimeters (i.e., backset values ranging between 1t and 4t)±0.25 millimeter. The preferred internal diameter of ring 50 is set at 201.5 millimeters±0.25 millimeter. Thus, it can be seen that wafer 34 is allowed some freedom of movement with respect to the center point of the backing pad and pressure plate combination.

As the wafer of FIG. 9 shifts within the retaining ring, localized flexure of the backing pad is also changed on an ongoing basis. For example, with the arrangement illustrated in FIG. 9, as the wafer 22 shifts to the right so as to approximately touch the inner diameter of retaining ring 50, a greater portion of the wafer device side surface 54 is elevated above backing pad surface 28. However, the opposed portion of the wafer edge (not visible in FIG. 9) is brought closer to the opposed free edge of the backing pad thus increasing edge polish in that local region of the wafer device side surface 54. Due to the preferred relative rotation of the pressure plate and hence of wafer 22 with respect to the polish pad upper surface, the localized shifting of polish rate due to off-centering of the wafer 22 is effectively averaged out. It is important to note that, during this time, a free interchange of slurry between the wafer and polish pad upper surface is maintained.

Figure 10:
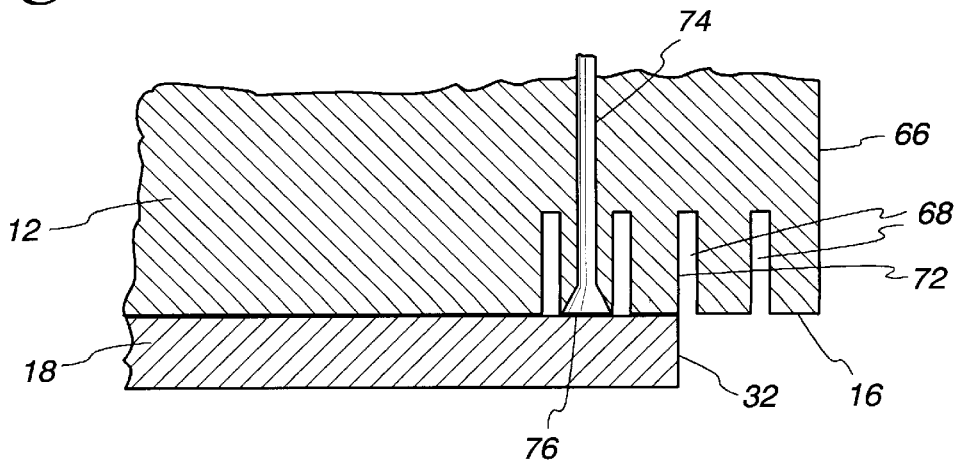
FIG. 10 is a fragmentary view of a carrier in combination with a backing pad.

Turning now to FIG. 10, pressure plate 12 has an outer free edge 66 and a forward or lower surface 16 facing backing pad 18. A series of slots or recesses 68 are formed in the pressure plate, so as to extend from the lower surface 16. As shown in FIG. 10, the outer free edge 32 of backing pad 18 is aligned with the left hand or inner wall 72 of one of the slots 68. Preferably, the inner slot wall 72 serves as a guide for a trim knife or the like to conveniently size the diameter of the backing pad 18, so as to quickly and easily achieve the precise backset desired.

For example, when the diameter of pressure plate 12 is made to closely correspond with the diameter of the wafer being polished, the backset is conveniently measured from the outer surface 66 of the pressure plate. The inner walls of the slots 68 can thereby be aligned with the desired backset spacing. Accordingly, using the inside slot walls as guides for a trim knife, different predetermined backset dimensions can be accurately determined without measuring equipment. Further, by controlling depth of insertion of the trim knife and the width of the slots 68, a predetermined trim knife angle can be quickly and easily determined to provide a ready definition for the angular inclination of the backing pad free edge 32 should a non-perpendicular edge be desired. Further, by aligning the trim knife with the outer slot wall, the direction of angular relief of the backing pad edge 32 can be changed to provide an upwardly converging edge of a backing pad, if such is desired.

By providing a plurality of slots 68, it is possible to routinely "fit" a backing pad to a batch of wafers being processed, since the amount of the backset can be easily increased from one slot to another in between polishing operations without requiring a remounting of the backing pad 18. If desired, a number of pins 74 having enlarged heads 76 can be provided to assist in separating unwanted outlying portions of the backing pad after a trimming operation is completed to increase the backset value.

Figure 11:
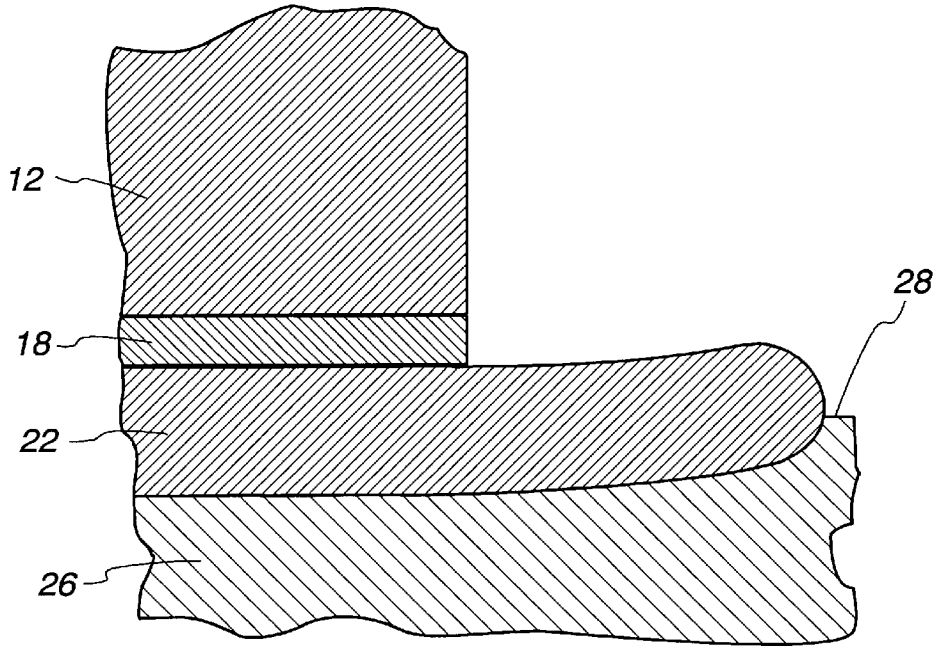
FIG. 11 is a fragmentary cross-sectional view showing an alternative polishing arrangement.

Turning now to FIG. 11, an alternative arrangement is provided for increasing backset. In the arrangement as shown in FIG. 11, the pressure plate 12 has been reduced to a diameter approximately equal to that of the backing pad 18. If desired, the backing pad 18 could be left "full size" i.e., generally equal to the diameter of the wafers being polished. One drawback is that the pressure plate 12 would have to be specially adapted for a particular backset value whereas, in the preceding figures, the "full size" pressure plate represents the condition most commonly encountered when adapting existing polishing machine arrangements to incorporate features of the present invention. However, if the pressure plate is being replaced or if a new machine is being provided, it may be desirable to follow the arrangement shown in FIG. 11.

Figure 12:
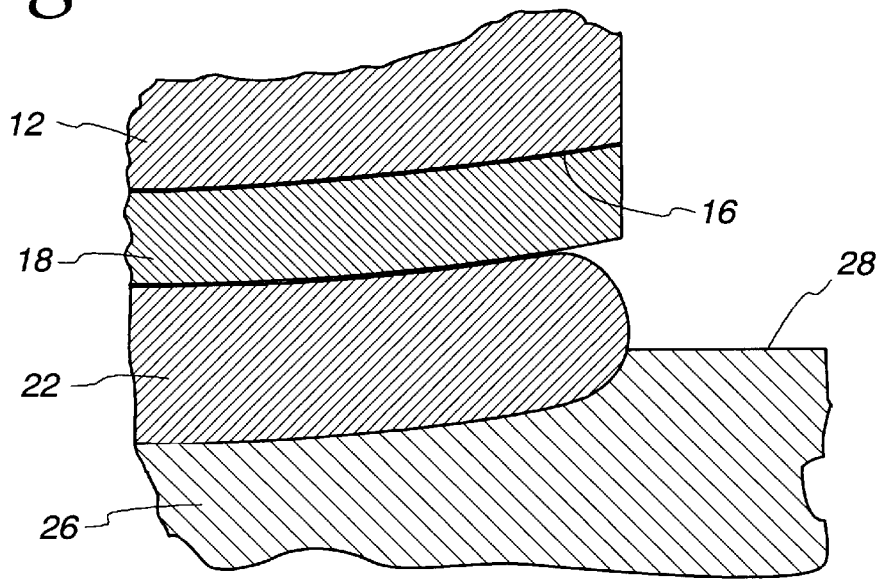
FIG. 12 is a fragmentary cross-sectional view showing another alternative polishing arrangement.

Reference is now made to FIGS. 8 and 12. As was seen above with reference to FIG. 8, the desired backset of the backing pad (with respect to the wafer) is increased to the point where the outer peripheral edge of the wafer is lifted a substantial amount to produce a locally convex device side surface. Where the additional tooling cost is justified, it is possible to determine the curvature of the "free", i.e., unbacked, outer peripheral edge of the wafer being bent during a polishing operation. This curvature is then reflected in the underneath surface 16 of pressure plate 12, in the manner indicated in FIG. 12. The backing pad 18 is sufficiently flexible to follow the bottom surface 16 of pressure plate 12.

When carrying out polishing operations according to the arrangement illustrated in FIG. 12, it is important to limit the amount of downforce applied by the pressure plate so as to avoid "bottoming out" or fully compressing the polish pad as such may cause artifacts in the device side of the wafer. Accordingly, it is important that the polish pad be sufficiently thick or sufficiently "stretchable" to follow the device side surface periphery while providing a certain amount of "cushion" for the center of the wafer. In certain applications, the polish pad is drawn by lateral friction forces applied by the wafer to "bunch up" or form a travelling wave at the leading edge of the wafer, and such is contemplated by the present invention, even where the "wave" is elevated somewhat above the relaxed polish pad contour.

As can be seen from the above discussion, it is believed that the amount of backset is not the only factor affecting the amount of reduction of the edge over-polish, although it does have a repeatable effect on over-polish reduction. Furthermore, backset is believed to have a direct proportional result on edge over-polish for relatively low hardness value backing pads. For backing pads having hardness values exceeding the Shore A range, backset has a well defined, if not proportional, effect on over-polish reduction. It is further believed that the resilience or ability of the wafer edge to bend under an applied force is a strong factor in influencing the reduction of edge over-polish, an effect perhaps even stronger than that of backset. However, due to the strict materials controls imposed on commercial semiconductor wafers, wafer resilience is generally well defined. However, if different types of wafers are encountered, it may be possible to test the wafers beforehand to determine their bending resistance and to compare the observed values to known wafers.

Figure 13:
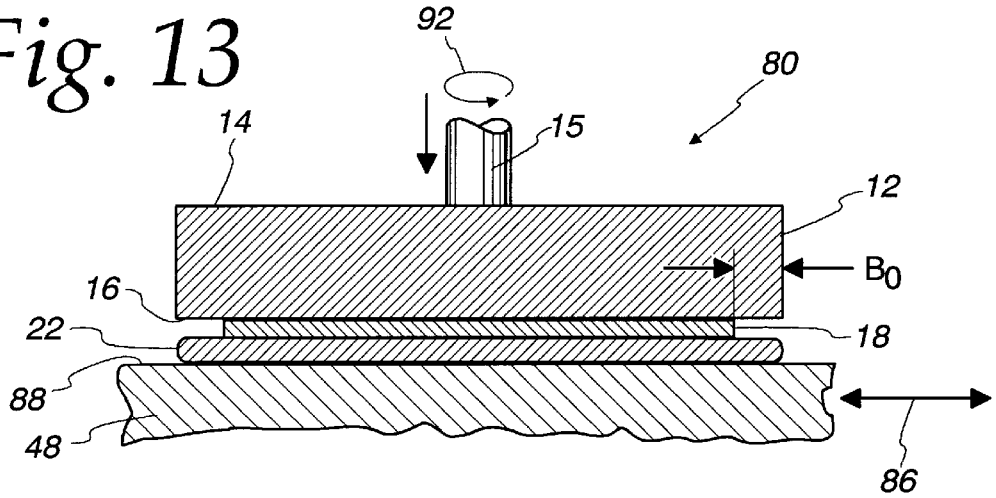
FIG. 13 is a cross-sectional view of an alternative polishing arrangement according to principles of the present invention.
Figure 14:
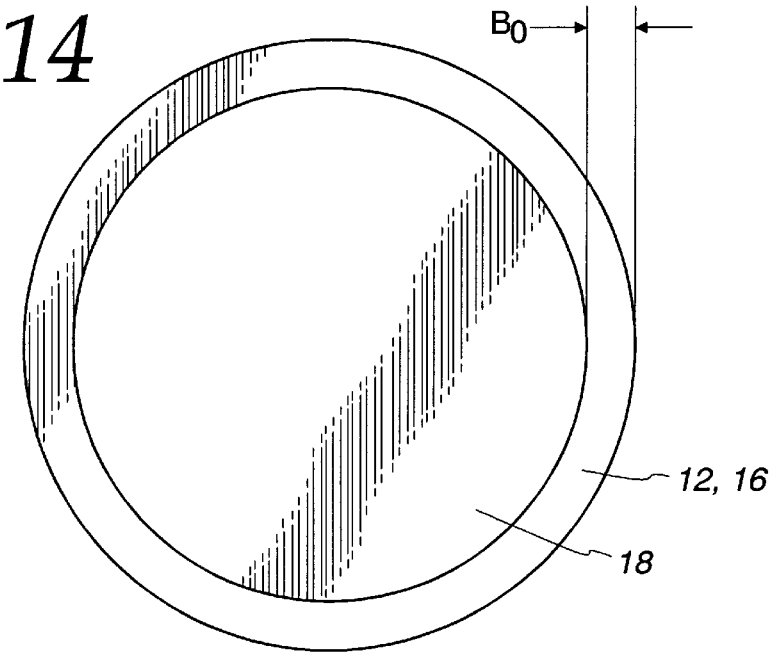
FIG. 14 is a bottom plan view of the backing pad and carrier of FIG. 13.

Turning now to FIGS. 13 and 14, an alternative polishing arrangement is generally indicated at 80. The pressure plate and backing pad assembly is the same as that referred to above and can, for example, include retaining ring and other features described above with respect to FIGS. 9 and 10. However, the arrangement of FIG. 13 contemplates the use of a polish pad 84 which travels along a linear path in either a single direction or in opposed directions indicated by arrow 86. The face of wafer 22 to be polished, is in contact with the upper surface 88 of polish pad 84 such that either the left or right hand side of wafer 22 in FIG. 13 assumes a leading edge position with respect to polish pad 84. As with the preceding embodiments described above, wafer 22 is rotated about the central axis of shaft 15, which is rotatably driven in the direction of arrow 92 or in an opposite rotational direction. In addition, as with the preceding embodiments, the carrier assembly may additionally be reciprocated back and forth across the surface of the polish pad with movement of the carrier assembly and hence the wafer 22, in directions generally parallel to the upper, active surface of the polish pad. It has been found, as with the rotatably driven polish pads of the preceding embodiments, the linear, belt-like polish pad 84 also gives rise to a "wave" action as indicated in FIGS. 6–8, for example.

Given polish pad characteristics and wafer-relative velocities similar to those for rotating polish pads, the amount of backset B, indicated in FIG. 14, will be similar to the values, and will lie within the ranges, described above with respect to rotatable polish pads. Examples of typical linear, belt-like polish pads are given in U.S. Pat. Nos. 5,692,947 and 5,558,568.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A method of polishing a surface of a semiconductor wafer having an outer peripheral portion, a predefined diameter, a predefined thickness, and a predefined rigidity, comprising:

providing a polishing pad;

providing a pressure plate of greater rigidity than the wafer;

providing a backing pad between the pressure plate and the wafer, the backing pad having a substantially uniform thickness, a substantially uniform hardness ranging between 30 Shore A hardness and 60 Shore D hardness and an outer diameter smaller than the outer diameter of the wafer by a backset amount;

the backset amount ranging between one and four times the predefined wafer thickness;

the pressure plate having an outer diameter at least as large as the outer diameter of the backing pad; and applying a downforce to the pressure plate and the backing pad to force a central portion of the semiconductor wafer into contact with the polishing pad and to bend the outer peripheral portion of the wafer toward the pressure plate to reduce downforce at the wafer edge.

2. The method of claim 1 wherein the backset amount ranges between 1.5 and 3 times the predefined wafer thickness.

3. The method of claim 1 wherein the backing pad hardness ranges between 55 Shore A hardness and 60 Shore A hardness and the backset amount ranges between 1.75 and 2.25 times the predefined wafer thickness.

4. The method of claim 1 wherein the backing pad hardness ranges between 50 Shore D hardness and 60 Shore D hardness and the backset amount ranges between 2.75 and 3.25 times the predefined wafer thickness.

5. The method of claim 1 further comprising the steps of:

providing a guide ring having a bottom surface and an open center of larger size than the wafer being polished;

joining the guide ring to the pressure plate so that the guide ring surrounds the wafer being polished;

dimensioning the guide ring so that the bottom surface of the guide ring avoids substantial compression of the polish pad as the wafer is being polished.

6. The method of claim 1 further comprising the step of rotating the polishing pad to produce a relative motion between the backing pad and wafer.

7. The method of claim 1 further comprising the step of moving the polishing pad along a linear path so as to produce a relative motion between the backing pad and wafer.

8. A method of polishing a surface of a semiconductor wafer having an outer peripheral portion, a predefined diameter, a predefined thickness and a predefined rigidity, comprising:

providing a polishing pad;

providing a pressure plate of greater rigidity than the wafer;

providing a backing pad between the pressure plate and the wafer, the backing pad having a substantially uniform thickness, a substantially uniform hardness;

the pressure plate having an outer diameter smaller than the outer diameter of the wafer by a backset amount;

the backset amount ranging between one and four times the predefined wafer thickness;

the backing pad having an outer diameter at least as large as the outer diameter of the pressure plate; and applying a downforce to the pressure plate and the backing pad to force a central portion of the semiconductor wafer into contact with the polishing pad and to bend the outer peripheral portion of the wafer toward the pressure plate to reduce downforce at the wafer edge.

9. The method of claim 8 wherein the backset amount ranges between 1.5 and 3 times the predefined wafer thickness.

10. The method of claim 8 wherein the backing pad has a hardness ranging between 55 Shore A hardness and 60 Shore A hardness and the backset amount ranges between 1.75 and 2.25 times the predefined wafer thickness.

11. The method of claim 8 wherein the backing pad has a hardness ranging between 50 Shore D hardness and 60 Shore D hardness and the backset amount ranges between 2.75 and 3.25 times the predefined wafer thickness.

12. The method of claim 8 further comprising the steps of:

providing a guide ring having a bottom surface and an open center of larger size than the wafer being polished;

joining the guide ring to the pressure plate so that the guide ring surrounds the wafer being polished;

dimensioning the guide ring so that the bottom surface of the guide ring avoids substantial compression of the polish pad as the wafer is being polished.

13. The method of claim 8 further comprising the step of rotating the polishing pad to produce a relative motion between the backing pad and wafer.

14. The method of claim 8 further comprising the step of moving the polishing pad along a linear path so as to produce a relative motion between the backing pad and wafer.

* * * * *

UNITED STATES PATENT AND TRADEMARK OFFICE

CERTIFICATE OF CORRECTION

PATENT NO. : 5,993,293

DATED : November 30, 1999

INVENTOR(S) : Cesna et al.

It is certified that error appears in the above-identified patent and that said Letters Patent is hereby corrected as shown below:

On the title page item [73], change "Speedram Corporation, Chanlder, Ariz." to

--Speedfam Corporation, Chanlder, Ariz.--

Signed and Sealed this

Thirtieth Day of January, 2001

*Attest:*

Q. TODD DICKINSON

*Attesting Officer*

*Director of Patents and Trademarks*